US006520458B2

(12) United States Patent
Podoll et al.

(10) Patent No.: US 6,520,458 B2
(45) Date of Patent: Feb. 18, 2003

(54) DISTRIBUTOR INSERT DUAL FUNCTION STAND AND STORAGE METHOD

(75) Inventors: Michael Podoll, Marion, IA (US); David Beck, Cedar Rapids, IA (US); Benjamin Boelter, Fayette, IA (US)

(73) Assignee: Highway Equipment Company, Cedar Rapids, IA (US)

( * ) Notice: Subject to any disclaimer, the term of this patent is extended or adjusted under 35 U.S.C. 154(b) by 6 days.

(21) Appl. No.: 09/681,164

(22) Filed: Feb. 6, 2001

(65) Prior Publication Data

US 2002/0104951 A1 Aug. 8, 2002

(51) Int. Cl.[7] ..... A01C 15/00; E01C 19/20

(52) U.S. Cl. ..... 248/166; 248/188.6; 222/180; 222/185.1; 222/610; 239/650; 239/663

(58) Field of Search ..... 239/650, 661, 239/663, 672; 222/160, 180, 181.1, 181.2, 185.1, 610; 414/150, 157, 216; 248/166, 188.1, 188.6, 436, 440, 440.1

(56) References Cited

U.S. PATENT DOCUMENTS

| | | | | | |
|---|---|---|---|---|---|
| 2,858,011 | A | * | 10/1958 | Wahl | 198/670 |
| 3,180,511 | A | | 4/1965 | Huisman | 414/498 |
| 3,322,429 | A | * | 5/1967 | Cervelli | 198/641 |
| 3,332,661 | A | | 7/1967 | Hand | 254/423 |
| 3,552,346 | A | * | 1/1971 | Garden | 141/313 |
| 3,623,621 | A | * | 11/1971 | Tarrant, Sr. | 414/469 |
| 3,819,120 | A | * | 6/1974 | Walker | 239/661 |
| 3,995,760 | A | | 12/1976 | Burgdorf et al. | 414/498 |
| 4,029,237 | A | * | 6/1977 | Miconi | 16/DIG. 13 |
| 4,076,299 | A | | 2/1978 | Dalton | 410/52 |
| 4,095,705 | A | * | 6/1978 | Hood | 198/532 |
| 4,124,167 | A | * | 11/1978 | Coleman | 192/84.961 |
| 4,166,581 | A | * | 9/1979 | Hetrick | 222/237 |
| 4,253,612 | A | * | 3/1981 | Schulze | 222/610 |
| 4,390,286 | A | | 6/1983 | Regaldo | 366/186 |
| 5,375,773 | A | * | 12/1994 | Lewis | 224/404 |
| 5,651,527 | A | | 7/1997 | Clarkson | 248/676 |
| 5,988,534 | A | * | 11/1999 | Kost et al. | 239/650 |
| 5,988,535 | A | | 11/1999 | Kime | 239/687 |
| 6,068,200 | A | * | 5/2000 | Kime | 239/176 |
| 6,089,478 | A | * | 7/2000 | Truan et al. | 239/661 |
| 6,422,490 | B1 | * | 7/2002 | Truan et al. | 239/659 |

OTHER PUBLICATIONS

STANDS ALONE—"Equipment Handling Systems" Website.

* cited by examiner

*Primary Examiner*—Ramon O. Ramirez
*Assistant Examiner*—Jon Szumny
(74) *Attorney, Agent, or Firm*—Simmons, Perrine, Albright & Ellwood, P.L.C.

(57) ABSTRACT

A distributor insert screen cover adapted for use both as a particulate bay screen cover and as a lightweight and stable distributor insert stand. A screen is provided in multiple panels that span portions of an open, particulate bay top wall. The panels may be fitted together when removed from the particulate bay to form a stand having a footprint or base of sufficient width to provide improved stability and to allow support of the distributor insert at a height sufficient to allow suspension of a lowly disposed release element above the ground. Simplified versions having fewer or alternative stand components are also disclosed.

11 Claims, 8 Drawing Sheets

DISTRIBUTOR INSERT DUAL FUNCTION STAND AND STORAGE METHOD

BACKGROUND OF INVENTION

It is common in many applications to provide an insert or vehicle body attachment suitable for mounting upon a truck body and adapted to carry and distribute a quantity of particulate matter over a surface. Most typically, small inserts in light trucks or larger inserts for use with, for example, dump trucks, are specifically adapted to apply salt and/or sand to heavily traveled roads, intersections, entry ramps and exit ramps, runways, parking areas, and other surfaces. In light of this seasonal usage that is typical for a large portion of the distributor insert market, inserts or attachments may lie dormant and generally unused for large periods of time throughout the year. Even where use is less seasonal, municipalities, counties, state governments, airports, and other users of such equipment typically employ trucks and other vehicles for multiple uses. Therefore, it is common for a distributor insert to be repeatedly mounted and removed from vehicles throughout the span of its useful life.

Typical distributor inserts comprise a V-shaped particulate bay body having a generally V-shaped cross section profile with sidewalls that slant inwardly and down to guide particulate matter to a conveyance means in the center of the particulate bay floor or bottom wall. Other distributor inserts may have particulate bay profiles that are otherwise curved or slanted to direct material to a conveyance means. It is most common to have a release element, such as a spinner or other particulate stream dispersion control means, disposed near a particulate bay conveyance means exit. Such release elements typically extend downward a distance below the floor or bottom wall of the bay to a position that is near to the surface that is to receive the distributed material.

Traditionally, to facilitate storage of the distributor insert, the downwardly extending release element is either removed to allow the particulate bay to rest on the ground, or the entire distributor insert is maintained above the ground by support means. In the alternative, the provision of pivoting connections in the construction and attachment of release elements has allowed movement of swing-up release elements from their lowered positions. Of course, provision of a swing-up release element results in added cost to distributor inserts.

Deconstruction of distributor inserts through removal of the release element or the provision of a pivoting release element may be a complicated process due to the existence of drive mechanisms, power means, and power transmissions associated with spreaders, blowers, spinners, or other release element components. In addition, the relatively complex release element, if removed, demands additional storage space or a separate storage support structure. Because the release elements may demand servicing in the off-season it is desirable to store the distributor inserts in manner that allows access to the release element. Further, because distributor inserts must often be placed into service upon short notice and under adverse weather conditions, it is desirable to maintain or store the distributor inserts in a "service-ready" state. Therefore, because removal of the release element may demand the cutting of chains, decoupling of hydraulic connections, or other power system disassembly, there is a need for storage means that do not demand the removal of release elements. There is also a need for storage means that allow access to the release element without demanding a separate storage structure for release elements and without demanding assembly of the distributor insert when it is necessary to place the insert into service.

Unfortunately, prior solutions for distributor insert storage have ranged from makeshift supports such as drums, barrels, and saw horses to specially designed stands (which themselves require storage when the distributor insert is mounted and in use) to massive, built-in-place support structures costing exorbitant sums and demanding a large amount of space. Other prior solutions to the problem of distributor insert storage include extendable legs, "gurney-style" break-away legs, or other support means built into the distributor insert (see, e.g., U.S. Pat. No. 3,180,511). Unfortunately, such supports add weight and cost to the distributor insert, thus decreasing the payload capacity and providing no beneficial function while the distributor is in use.

In some instances, and in particular with makeshift storage means, the typically V-shaped distributor inserts have been stored in unstable positions. The floor or bottom wall of the distributor insert is generally narrow relative to the overall insert. As such, resting the insert upon the bottom wall may result in tipping of the insert.

There is therefore a need for a distributor insert storage stand that provides for stable support. There is also a need for a distributor insert storage stand that serves as a functional part of the distributor insert when the insert is in use. There is a further need for a storage stand that serves as a functional part of the distributor insert and that allows storage without removal of the mechanically complex release element. Finally, there is a need for a support stand that does not itself require storage when the distributor insert is in use.

When used to distribute road salt and other materials, it is important for proper operation of most distributor inserts to provide granular material of a desired size and to avoid the agglomeration of particles into large masses. Such masses may be incapable of being conveyed and distributed by the distributor insert conveyance means. The introduction of moisture or foreign material into stored material supplies may result in the formation of undesirable large blocks. Therefore, there is a need for a screening or breaking step prior to or during particulate bay loading. It is an object of the present invention to meet the needs recited herein in addition to other useful purposes as will be apparent to those of skill in the art upon being taught the present invention. In particular, it is an object of the present invention to provide an improved distributor insert having a screening means that serves as a stable, convenient, and lightweight stand when the insert is not in use.

SUMMARY OF INVENTION

A distributor insert panel stand is disclosed as being adapted for use both as a distributor insert wall panel and as a lightweight and stable distributor insert stand. Preferably, one or more of the wall panels are perforated or reticulated to serve a screening function when used as a cover for an otherwise generally open top wall. The panels may be fitted together when removed from the particulate bay to form a stand having a footprint or base of sufficient width to provide improved stability and to allow support of the distributor insert at a height sufficient to allow suspension of the lowly disposed release element above the ground.

In the alternative, and as a simplified embodiment, a selected particulate bay element may be detachable from a working position to a storage position where it may be securely attached near the particulate bay rear side to allow storage of the insert in a generally angled relationship relative to a support surface. Importantly, this arrangement allows for stable storage and protection of the mechanically complex release element without demanding removal of the release element and without obstructing access to the release element. In this manner, the distributor may be stored without demanding the purchase and housing of a separate stand, without demanding the addition of elements that are non-functional when the distributor insert is in use, with the demand of only a minimal amount of effort in the removal and placement of particulate bay elements to convert the same from a use-mode function to a storage-mode function, and with easy access provided for servicing the release element. As illustrated herein, end walls, side wall portions, or other distributor insert bodies may be utilized as stand elements. However, for ease of use, lightweight perforated or reticulated screening top wall panels are preferred.

DETAILED DESCRIPTION

Figure 1:
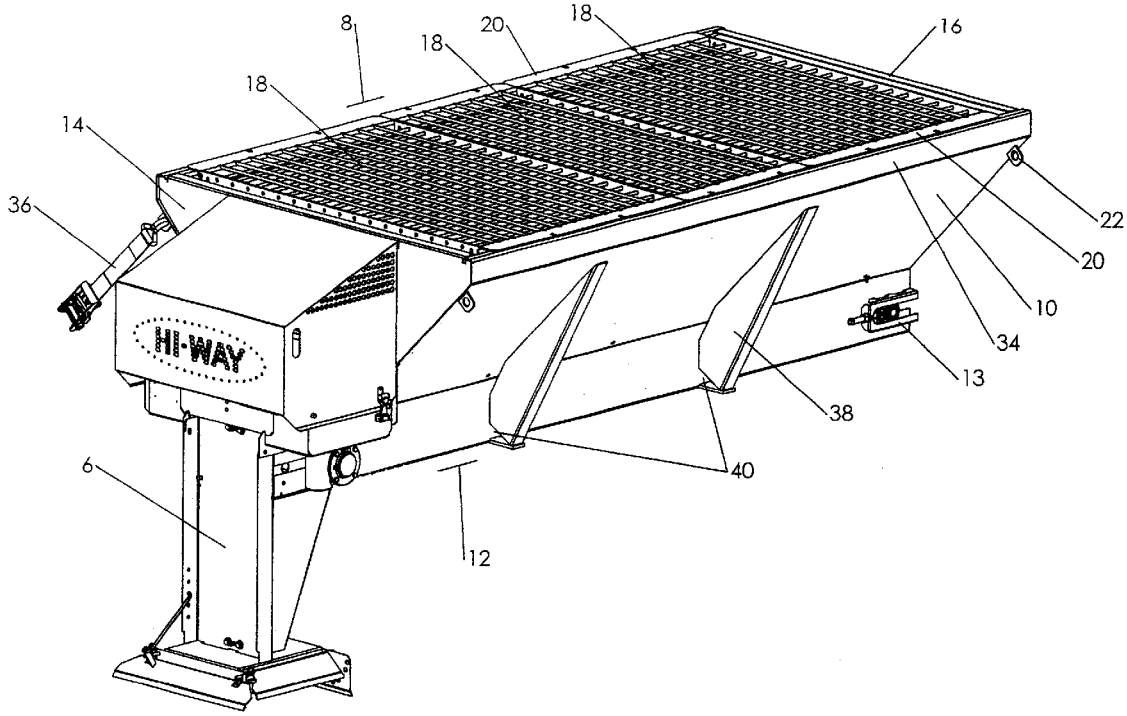
FIG. 1 is a perspective view of a distributor insert having a V-shaped particulate bay, a downwardly extending distribution element, and a three-paneled screen fitted across an open top wall.
Figure 2:
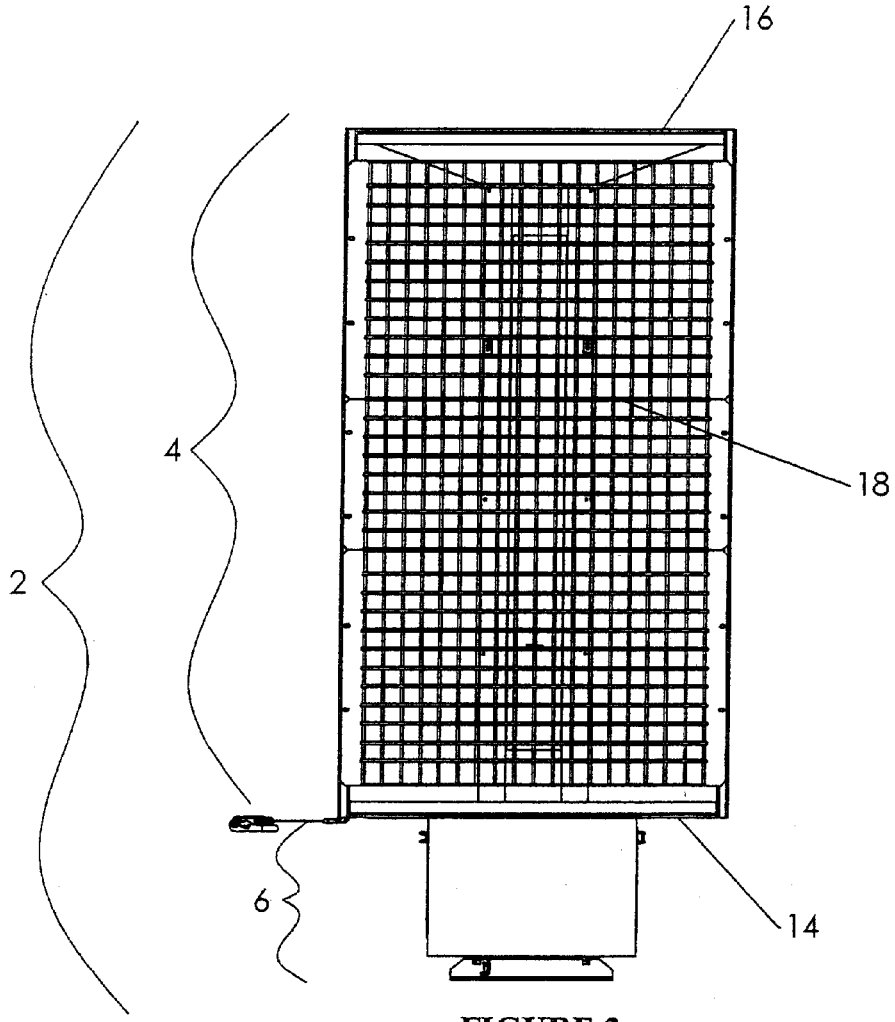
FIG. 2 is top view of the device of FIG. 1.
Figure 3:
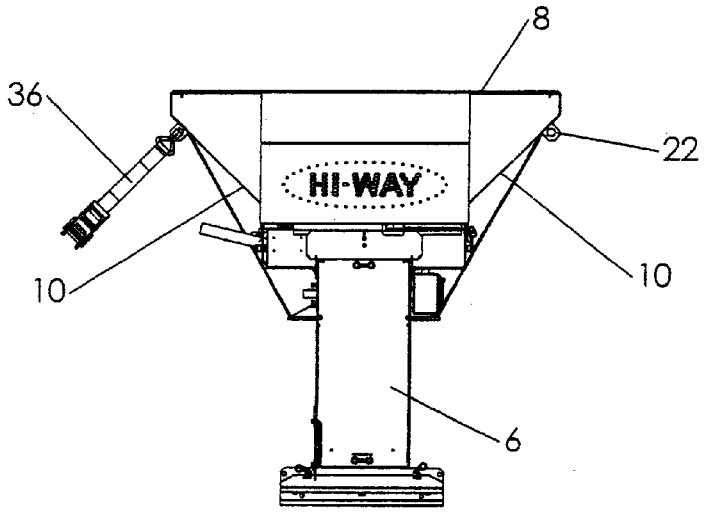
FIG. 3 is an end elevation view of the device of FIG. 1.
Figure 4:
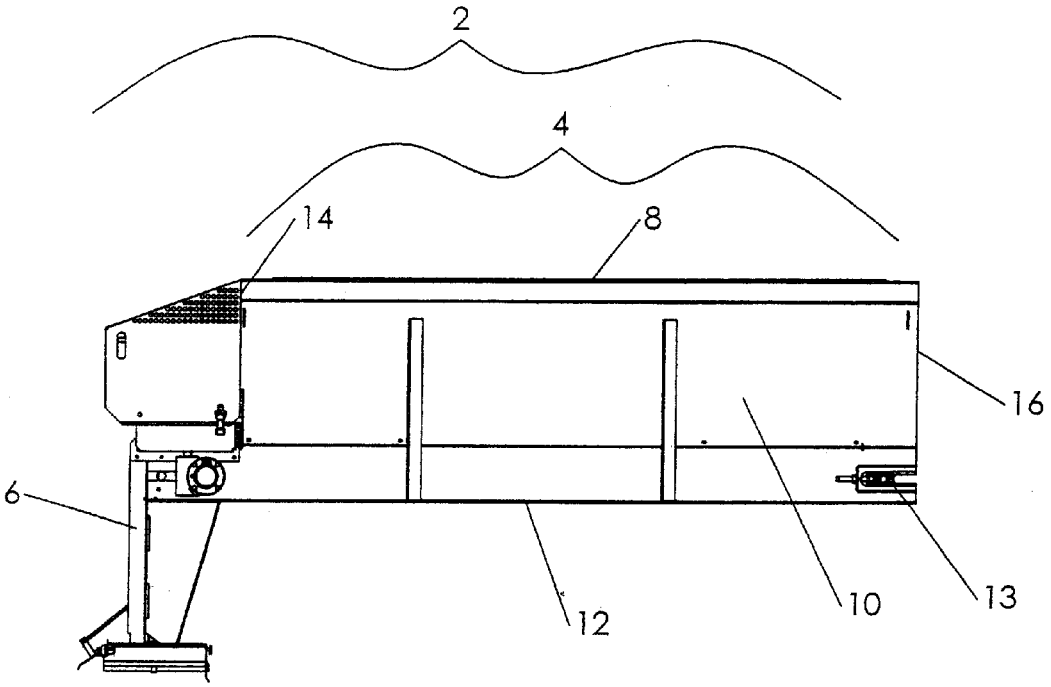
FIG. 4 is a side elevation view of the device of FIG. 1.
Figure 5:
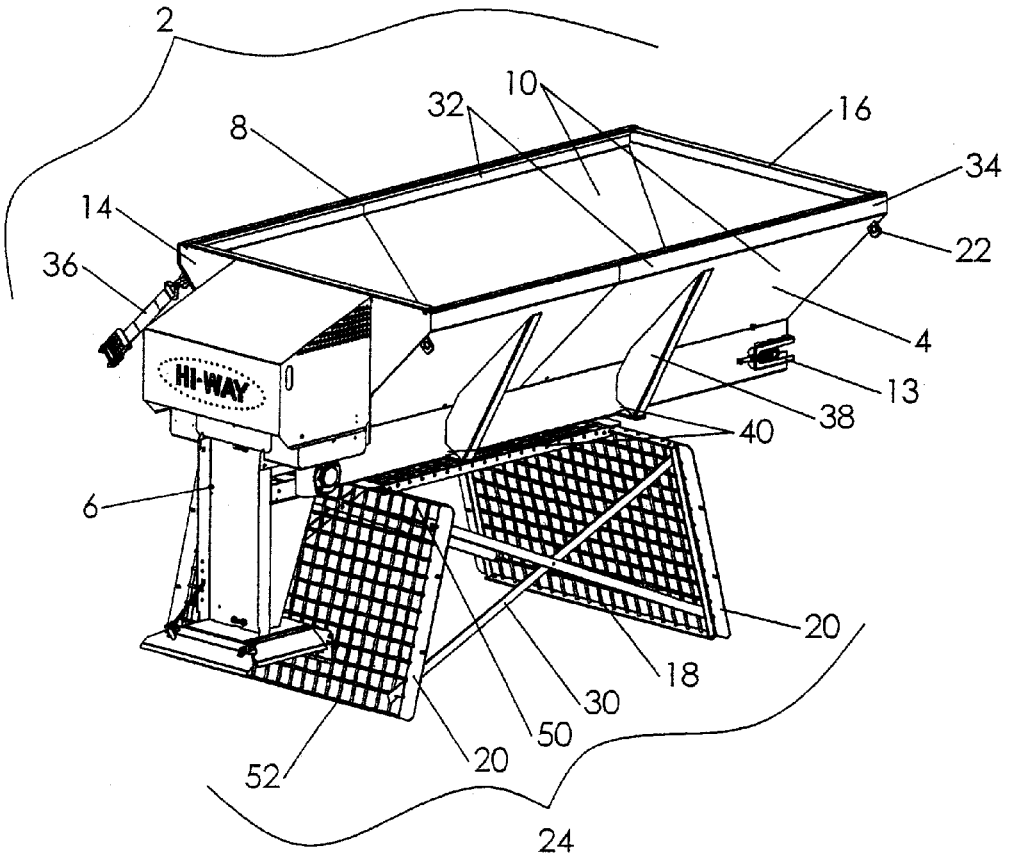
FIG. 5 is a perspective view of a distributor insert having a V-shaped particulate bay, a downwardly extending distribution element, and a three-paneled screen arranged to serve as a support stand.

With reference first to FIGS. 1 through 4, a vehicle mountable distributor insert 2 is disclosed in its operating configuration. The insert comprises a particulate bay 4 and a release element 6. In the preferred embodiment that is provided herein by way of example and not of limitation, the particulate bay 4 comprises particulate bay bodies including a forward 16 and rear 14 end wall, an open top wall 8, and sloped side walls 10 that angle inwardly toward a generally narrow bottom wall 12. Various other wall configurations may be used including curved or vertical walls. The release element 6 is positioned relative to an opening in the particulate bay 4 and extends downwardly from the particulate bay 4. Particulate bay bodies may also include panel or wall edges 34 (that may comprise separate frames or that may serve as reinforcing lips) and reinforcement elements 38. The preferred distributor inserts include a conveyance means disposed to move particulate material rearward in through the particulate bay. FIGS. 1, 4, and 5 illustrate conveyance means drive elements 13.

Figure 6:
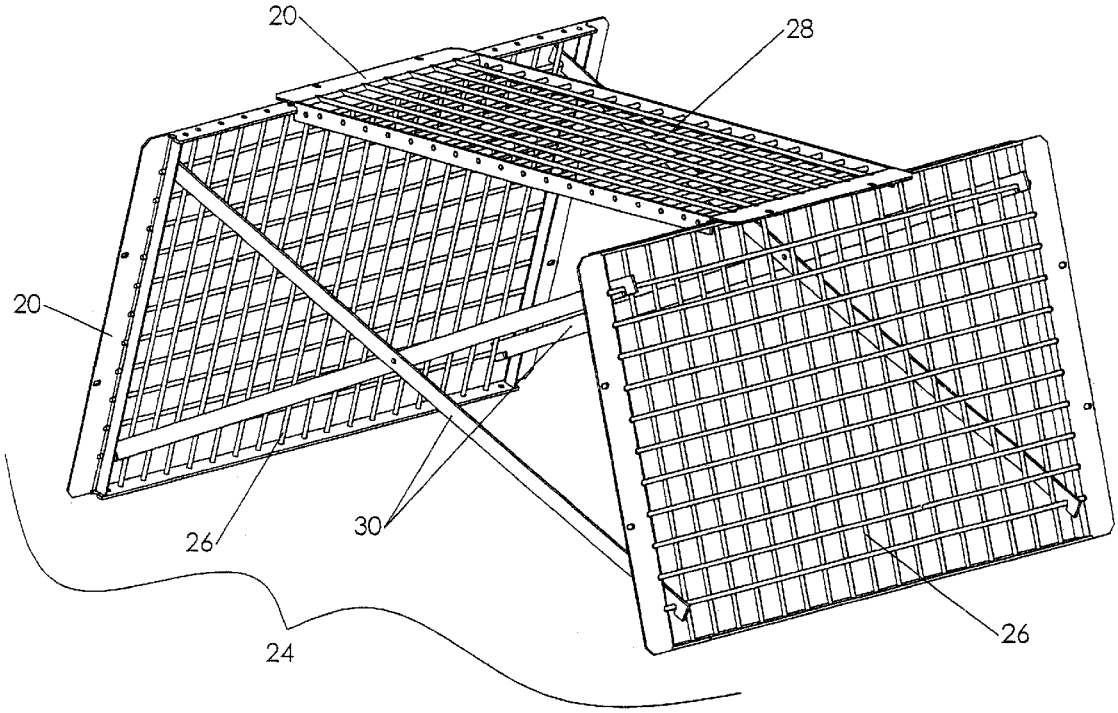
FIG. 6 is a perspective view of the support stand illustrated in FIG. 5.
Figure 7:
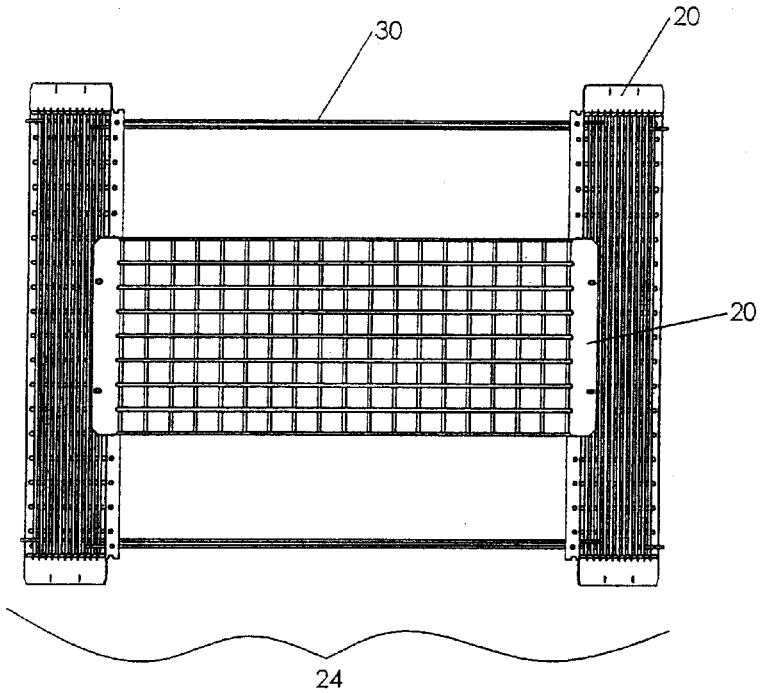
FIG. 7 is a top view of the support stand illustrated in FIG. 5.
Figure 8:
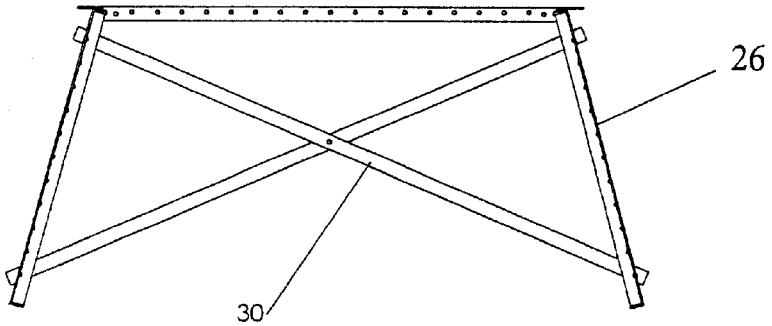
FIG. 8 is a side elevation view of the support stand illustrated in FIG. 5.
Figure 9:
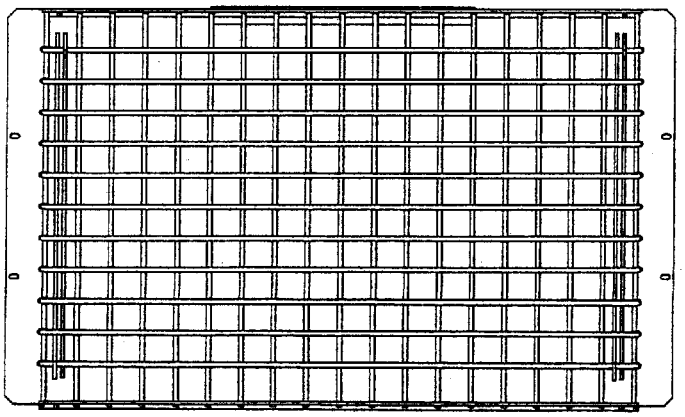
FIG. 9 is an end elevation view of the support stand illustrated in FIG. 5.
Figure 10:
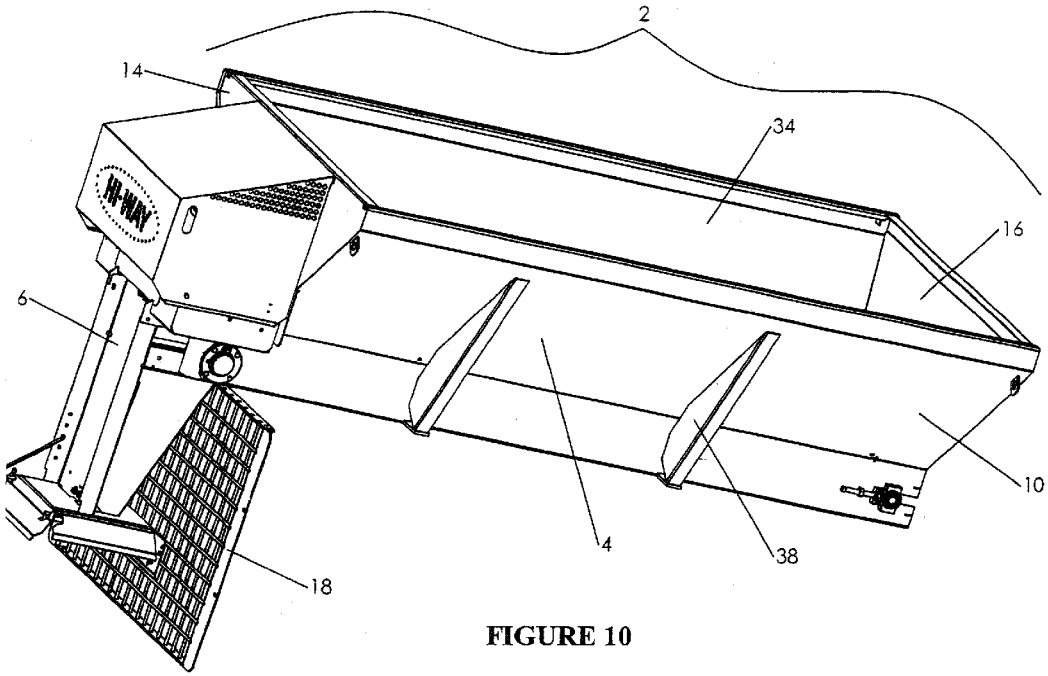
FIG. 10 is a perspective view of a simplified screen-panel support embodiment.
Figure 11:
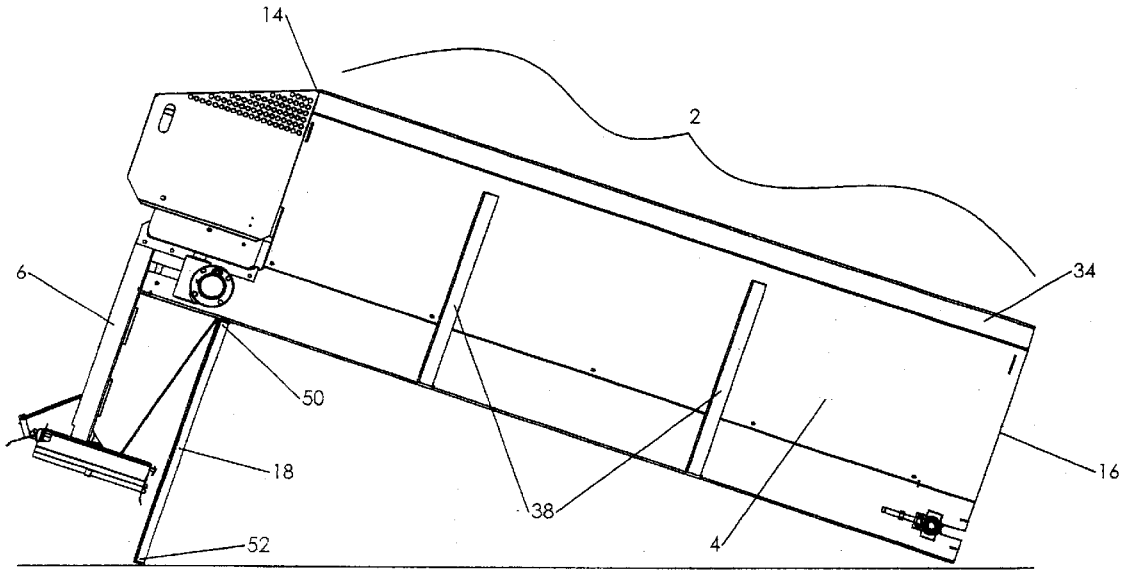
FIG. 11 is a side view of the simplified embodiment illustrated in FIG. 10.
Figure 12:
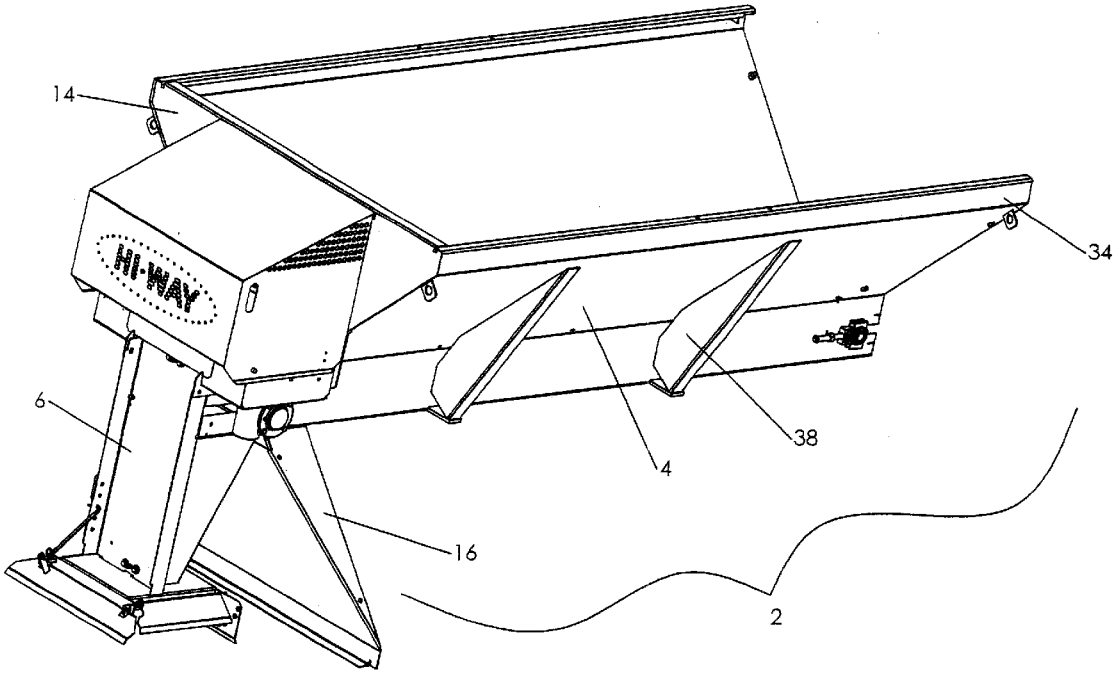
FIG. 12 is a perspective view of a simplified end wall support embodiment.
Figure 13:
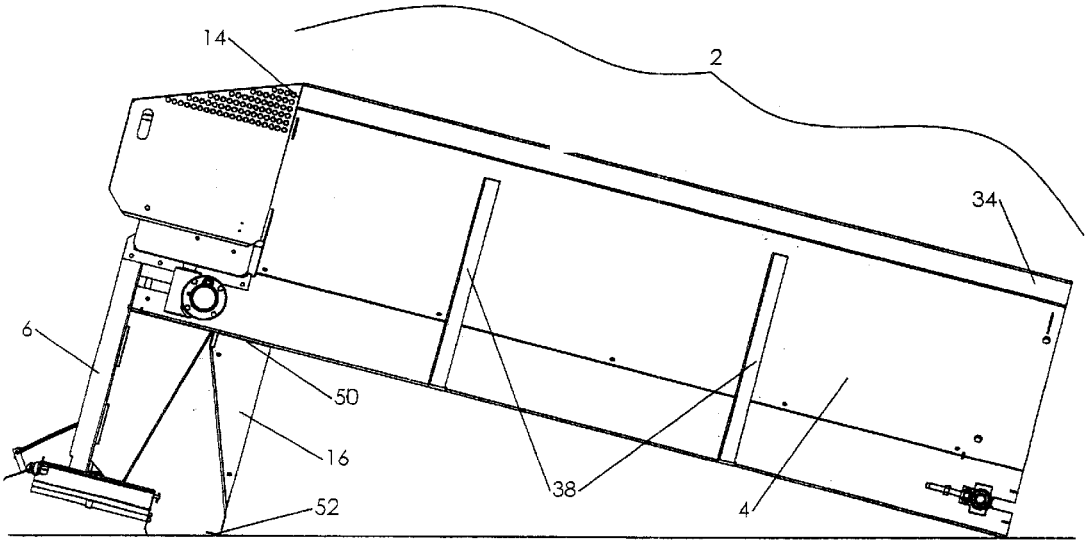
FIG. 13 is a side view of the simplified embodiment illustrated in FIG. 12.

A multiple-paneled top wall screen cover 18 spans the top wall 8. The preferred panels comprise generally reticulated planar structures having support lips 20 extending endwise therefrom. In this preferred embodiment, two of the three panels are of similar dimensions 26 and are wider than the third panel 28 (See FIG. 6). As distributor inserts of varying sizes are constructed, it is preferred to provide a variety of standard panel sizes that may be mixed and combined as desired to cover generally open top walls 8 of varying sizes. Connectors 22 and stabilization means 36 such as straps or tie-downs are also provided. Through the use of stabilization means 36, the distributor insert may be secured to a vehicle body when in use or to a support stand 24 when in storage to further minimize the risk of tipping.

Figure 14:
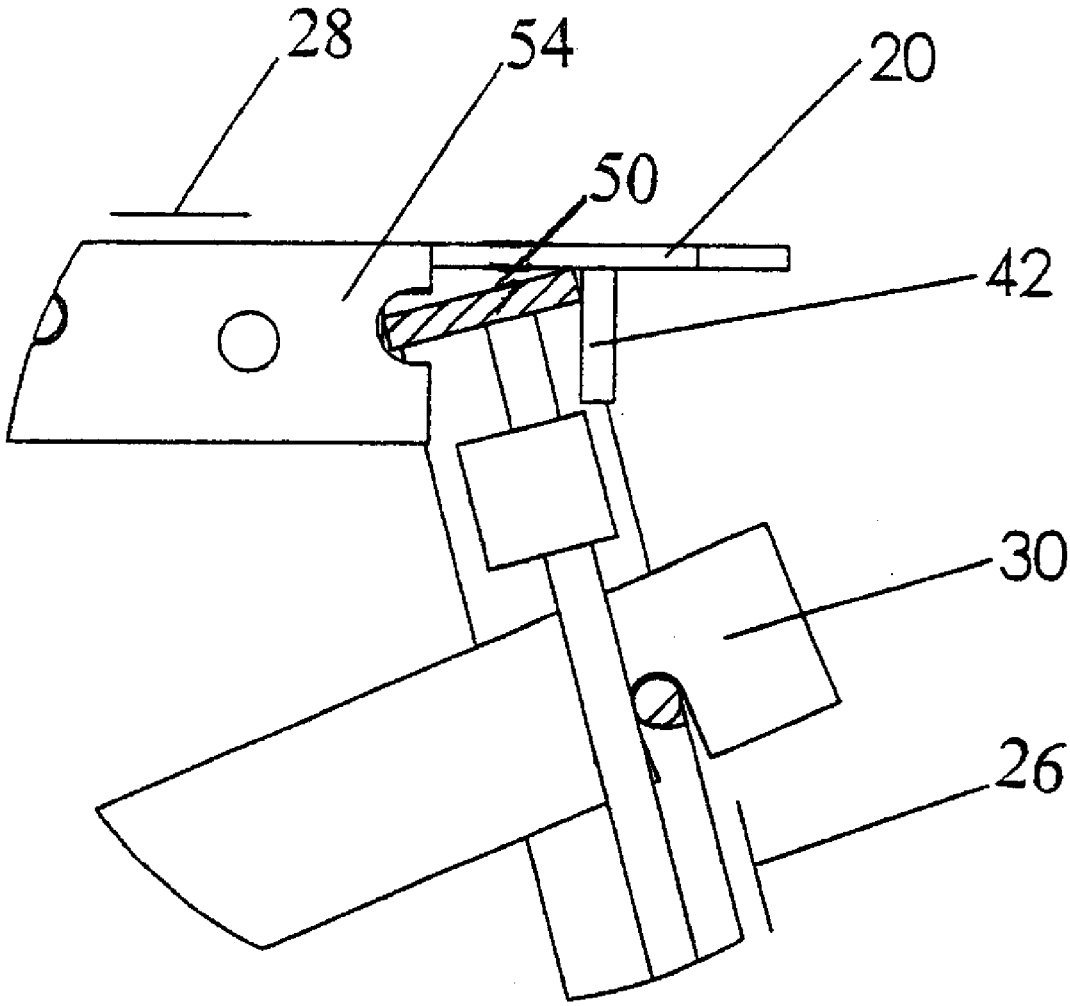
FIG. 14 is a detailed side view of the panel intersection in a constructed support table.

With reference now to FIGS. 5 through 9 and 14, the same distributor insert 2 is shown in its storage configuration. The three-panel top wall screen cover 18 has been removed from the top wall and assembled to form a table or support structure 24. The two, wider, similarly dimensioned panels 26 comprise the leg panel supports, while the third panel 28 comprises a generally horizontal table top wall. As illustrated, two pairs of cross supports 30 are provided to stabilize the "leg" panels in a desired position. Cross-support stabilization means 30 are generally necessary only as a redundant stabilization system. As illustrated in FIG. 14, panel attachment elements 42 may be provided. The preferred panel attachment elements comprise simple retaining bodies that extend from a panel lip 20 opposite a table panel frame 54. In this manner, the frame of an adjoining panel may be at least partially constrained. Depending on the desired angle of intersection of "leg" panels with a table top wall panel 28, the type of attachment elements selected, and the overall stability of the support structure, cross-support elements 30 may be included or deleted as a matter of necessity or user preference. It is preferred to provide cross supports 30 and cross support storage means 40 such as slots or other connecting means on the particulate bay 4. In other embodiments, the cross supports may serve as frame elements 34 or as tools for the clearing or breaking of particulate matter agglomerations that may have formed in the particulate bay 4.

In addition to the preferred embodiment described above, the present invention may also be practiced through the use of a detachable particulate bay wall other than a top wall screen. Such an at-least-partially deconstructable particulate bay may include, by way of example and not limitation detachable particulate bay side walls 10, end walls 16, wall portions 32, reinforcement means 38 or frames 34. Such bodies may be employed for stand construction in addition to or in substitution for the screen panels 18. Such an embodiment may be preferred in applications where minimization of insert weight is a high priority or wherein particulate screening is not a required function. Further, support structure or table elements may comprise open frame elements (for example, a removable particulate bay generally open top wall frame 34) or non-panel particulate bay bodies (for example, reinforcement means 38) rather than panels. In general, however, the use of top wall panels or screens 18 has been found to be the simplest, most convenient, and therefore preferred method of construction.

As illustrated in FIGS. 10–13, the present invention may be practiced without construction of a table 24. Rather, stable and safe storage of the distributor insert 2 may be provided through the provision of at least one detachable body that may be removed and positioned to have one end on a support surface and a second end generally above the support surface and securely attached to the particulate bay 4. In this simple embodiment the particulate bay is supported by the support surface near the bay front side, and the particulate bay is supported by the removable body second end near the particulate bay rear side. The removable body length as measured from the first end 50 to the. second end 52 is selected to be greater than the length of that portion of the release element 6 that extends below the particulate bay bottom wall 12. As illustrated throughout, the table heights in the first embodiments are also selected to provide a length from a first end 50 to a second end 52 that is greater than the length of the downwardly extending portion of the release element. In this manner, when the distributor insert 2 is allowed to rest in angled position with the distributor insert rear side supported off of the ground or other support surface by the removable body, the distribution element 6 is suspended above the support surface. In this embodiment, it is preferred to provide a distributor insert engagement on the particulate bay bottom wall that may cooperatively engage the removed body to form a rigid, angled, stable structure. The engagement in cooperation with the removed body may comprise any convenient connection assembly such as a simple opening and insertion element, or a more complex locking means.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is:

1. A method for storing a distributor insert, said method comprising the steps of:

(a) providing a distributor insert comprising a release element and particulate bay, said release element extending a first distance from said particulate bay, and said particulate bay comprising at least one detachable body;

(b) selecting a particulate bay detachable body from said distributor insert, said selected particulate bay detachable body extending a second distance, said second distance being greater than said first distance;

(c) removing said selected particulate bay detachable body from said distributor insert;

(d) placing said particulate bay detachable body on a support surface; and (e) placing the distributor insert on said selected detachable body so that said release element is suspended above said support surface.

2. The method of claim 1 wherein:

the selected particulate bay detachable body comprises a top wall portion.

3. The method of claim 2 wherein:

the top wall portion has a plurality of openings formed therein.

4. The method of claim 1 wherein the selected particulate bay detachable body comprises a side wall portion.

5. The method of claim 1 wherein the selected particulate bay detachable body comprises an end wall portion.

6. The method of claim 1 wherein the selected particulate bay detachable body comprises a frame element.

7. The method of claim 1 wherein the selected particulate bay detachable body comprises a reinforcement element.

8. A method for storing a distributor insert, said method comprising the steps of:

(a) providing a distributor insert comprising a release element and a particulate bay, said particulate bay comprising a first, second, and third detachable panel;

(b) removing from said distributor insert the first, second, and third detachable panels;

(c) positioning said first and said second detachable panels on a support surface;

(d) positioning said third detachable panel across said first and second detachable panels;

(e) securing said third detachable panel to said first and second detachable panels;

(f) placing said distributor insert on said third detachable panel so that said release element is suspended above said support surface.

9. The method of claim 8 wherein at least one of said detachable panels has a plurality of openings formed therein.

10. The method of claim 8 wherein said detachable panels comprise generally reticulated particulate bay top wall panels.

11. A distributor insert for the distribution of particulate matter onto a surface, said distributor insert comprising:

(a) a particulate bay having a top wall, said top wall having an opening formed therein;

(b) a distribution element combined with said particulate bay and extending downwardly therefrom for a first distance;

(c) a removable, top wall opening cover, said cover having a plurality of openings formed therein and said cover extending across said top wall for a second distance;

(d) said second distance being greater than said first distance;

(e) wherein said top wall opening cover comprises at least three top wall opening cover panels, and wherein at least one of said three top wall opening cover panels comprises attachments adapted to engage another of said top wall opening cover panels; and wherein the cover panels comprise support lips and wherein an attachment comprises a body having a first end connected to the cover panel lip and a second end disposed distally thereto to accommodate the insertion of another of said panels.

* * * * *